US005383314A

United States Patent [19]

Rothberg

[11] Patent Number: 5,383,314

[45] Date of Patent: Jan. 24, 1995

[54] DRAINAGE AND SUPPORT MAT

[75] Inventor: Henry M. Rothberg, Woodbridge, Conn.

[73] Assignee: Laticrete International, Inc., Bethany, Conn.

[21] Appl. No.: 95,017

[22] Filed: Jul. 19, 1993

[51] Int. Cl.[6] ..... E02D 19/00

[52] U.S. Cl. ..... 52/169.5; 52/408; 428/167; 428/178; 405/43; 405/45

[58] Field of Search ..... 52/169.5, 169.14, 408; 465/43, 45; 428/167, 178

[56] References Cited

U.S. PATENT DOCUMENTS 5,052,161 10/1991 Whitacre .

5,105,595 4/1992 Tokei et al. ..... 52/169.5 X

*Primary Examiner*—Carl D. Friedman

*Assistant Examiner*—Creighton Smith

*Attorney, Agent, or Firm*—Salzman & Levy

[57] ABSTRACT

The present invention features a drainage and support mat used as a supporting and drainage surface beneath sods, plantings, gravel and roofs and decks of concrete. The mat is made of a high-impact plastic sheet such as polystyrene, PVC, PET, etc., and consists of evenly spaced, upwardly projecting, dimple-type protuberances. Channels that are formed between the dimple projections allow water to drain off the mat surface. For greater support and load-bearing capacity, the dimples have a substantially truncated, trapezoidal or hemispherical shape. The flattened, truncated portion (upper surface) of each dimple normally retains a small amount of drainage water. To counteract this, each of the protuberances of the mat has a slotted section in or adjacent to it. The slotted section crosses the flattened, truncated portion of the dimples, allowing any accumulating water to run off and down the sides of the protuberance.

10 Claims, 4 Drawing Sheets

DRAINAGE AND SUPPORT MAT

FIELD OF THE INVENTION

The present invention pertains to a drainage mat used as a supporting and drainage surface beneath sods, plantings and gravel, as well as roofs and decks of concrete, and, more particularly, to a drainage mat having a positive drainage design for a thorough water run-off, as well as a positive load-transfer capability to support the weight of increased pressure.

BACKGROUND OF THE INVENTION

In the past, a variety of formed plastic sheets have been used as foundational and drainage members under sods, plantings and gravels, as well as roofs and decks of concrete. These plastic sheets commonly comprise a series of raised dimples that are round, square, conical or rectangular in shape. These dimples provide structural integrity to the mat. Drainage channels are often separately disposed between the dimples to provide for water run-off. The mat is usually overlaid with a screen mesh of polypropylene or one of a variety of non-woven fabrics that allow some permeability and additional support.

The drainage channels draw off most of the water from these mats, but the dimples themselves collect water for which there is no outlet. The amount of dimple-retained water is small compared to that involved in the drainage channel run-off, but this small amount of water nevertheless tends to freeze or thaw, depending on the weather. Freezing and thawing cause expansion and contraction stresses in the foundation. This dimple-retained water is also a breeding place for fungi, bacteria and odor-causing organisms. Eventually, this dimple-retained water will cause deterioration of the plastic dimples and, hence, undermine the mat foundation.

The present invention features a new drainage mat design that provides slots through or adjacent to the dimples. Connected to the main drainage channels, these slots act as drainage channels for the dimples. These added slots, therefore, provide a positive drainage that eliminates the dimple-retained water.

In addition, the prior-art mats have generally been designed for a maximum support of about 14,400 psf or approximately 100 psi. Unfortunately, this load capability is usually insufficient to accommodate heavy traffic, such as trucks and snow-removal equipment. Furthermore, these prior-art mats did not provide for the proper drainage necessary for the exterior installation of ceramic tile, marble, stone or other rigid material. If not properly supported, such additional materials can crack under a heavy load. Without the proper drainage, moisture can also accumulate in the load-bearing mortar and cause severe frost damage.

The current invention features a new, load-bearing design for a drainage mat that will support the aforementioned heavier loads, as well as eliminate the need for additional overlays of strengthening mesh or fabric.

The added, load-bearing capability of the inventive mat allows for an overlay of a two-inch concrete topping, which will increase the overall composite's capability for support. The composite will then be able to support extremely heavy traffic loads, such as snow-clearing and maintenance equipment. The unique design of this invention reduces the overall thickness of the conventional four-inch concrete or mortar support for ceramic and marble, thereby reducing dead load by 50% and/or by 30 psf.

DISCUSSION OF RELATED ART

In U.S. Pat No. 3,310,921, entitled "Glass Tile System" and issued Mar. 28, 1967, to FORCADELL, tiles are bracketed together using a contiguous support structure to improve adhesion to walls.

In U.S. Pat. No. 3,501,878, entitled "Sound and Heat Insulating Panels" and issued Mar. 24, 1970, to SEGAL, a molded plastic base support is shown for the panels. The molded support comprises a series of hollow, truncated pyramid protuberances.

In U.S. Pat. No. 3,507,634, entitled "Composite Metal Structure" and issued Apr. 21, 1970, to O'DRISCOLL, a structural metal sandwich is illustrated. The sandwich comprises a metal sheet welded to a second sheet having a plurality of pyramidally-shaped, spaced distortions.

In U.S. Pat. No. 3,533,896, entitled "Anchoring Device of Thermoplastic Resin" and issued Oct. 13, 1970, to HARTIG, a molded sheet is shown having a series of ribs and cavities embedded therein. The sheet is pressed into a pourable substrate, providing internal strengthening for the pourable material.

In U.S. Pat. No. 4,128,982, entitled "Means and Method of Tiled Surface Construction" and issued Dec. 12, 1978, to WEAVER, an expanded or molded plastic sheet having perforations is illustrated. The sheet is used for replacing metal lathing. Means are depicted for attaching straight guides for the application of plaster and cement mortar in the installation of ceramic tile.

In U.S. Pat. No. 4,640,854, entitled "Self-Supporting Composite Plate, Especially for Double Floors" and issued Feb. 3, 1987, to RADTKE, is shown. A pan featuring a number of wells is used for receiving a poured material (such as concrete) that will harden.

In U.S. Pat. No. 3,666,606, entitled "Composite Membrane and Tile System" and issued May 30, 1972, to STOKES, grouted tiles are shown disposed upon several supporting layers, including an intermediate sheet and an elastomeric layer.

In U.S. Pat. No. 4,943,185, entitled "Combined Drainage and Waterproofing Panel System for Subterranean Walls" and issued Jul. 24, 1990, to MC GUCKIN et al, dimpled panels are shown covered with fabric comprising, on one side thereof, a continuous waterproof sheeting. The system comprises a composite of one sheet with dimples and a fabric filter surface in combination with another parallel sheet that is impermeable to water. The method of drainage described for this composite does not provide positive drainage through each dimple as illustrated by the present invention. Furthermore, this patented system differs from the invention by its need for a fabric sheet.

In U.S. Pat. No. 4,590,731, entitled "Tile Reinforcing Grid" and issued May 27, 1986, to DE GOOYER, an interlocking grid is depicted, comprising a plurality of strips arranged in a geometric pattern. The grid is used as a reinforcement for mortar.

In U.S. Pat. No. 5,052,161, entitled "Tile Application Structure" and issued Oct. 1, 1991, to WHITACRE, a plastic sheet having dimples is used as a base for the installation of ceramic tiles. The purpose of this sheet is to prevent structural cracks from forming in the tile due to movement in the floor. The need for drainage is never contemplated, since this construction is primarily used in a building's interior.

SUMMARY OF THE INVENTION

In accordance with the present invention, there is provided a drainage and support mat used as a supporting and drainage surface beneath sods, plantings, gravel and roofs and decks of concrete. The mat comprises a high-impact plastic sheet such as polystyrene, PVC, PET, etc., with evenly spaced, upwardly projecting, dimple-type protuberances disposed thereupon. Channels that are formed between the dimple projections allow water to drain from the mat surface. For greater support and load-bearing capacity, in one embodiment, the dimples have a substantially truncated, trapezoidal shape. The flattened, truncated portion (upper surface) of each dimple normally retains a small amount of drainage water. To counteract this, each of the protuberances of the mat, in accordance with the invention, comprises means defining a slotted section. The slotted section traverses the flattened, truncated portion of the dimples, thereby allowing any accumulating water to run off the flattened, truncated surface and down the sides of the protuberance. The slots can be straight, X-shaped, star-shaped, etc. In an alternate embodiment, the dimples are hemispherical protrusions having slots adjacent the upper, truncated portions thereof. The mat is usually laid upon a concrete roof, deck or balcony. A waterproof membrane can be placed below the mat (if so desired), but it is not generally required. The mat is then usually overlaid with between one-half to two inches of mortar.

In another embodiment, the mat can be inverted, so that the dimples rest upon the concrete roof. In such an embodiment, the slotted sections would extend through the truncated surface. The open slots allow water to drain from the dimples, which now act as water-accumulating wells. In such an embodiment, the slotted areas can also be replaced with holes or other open avenues of drainage.

BRIEF DESCRIPTION OF THE DRAWINGS

A complete understanding of the present invention may be obtained by reference to the accompanying drawings, when considered in conjunction with the subsequent detailed description, in which.

For the sake of brevity and clarity, like elements and components in the FIGURES will bear the same designations.

DESCRIPTION OF THE PREFERRED EMBODIMENT

Generally speaking, the invention features a drainage and support mat used as an undergirding support in roofs, decks and other similar constructions. The drainage and support mat comprises a plastic, water-impermeable sheet of high-impact strength and having truncated, trapezoidally-shaped protuberances projecting therefrom. Water is drawn off by channels formed between the protuberances. However, small amounts of water do tend to collect on top of the truncated surfaces and cause mildew and rot. The invention features drainage slots disposed upon or adjacent these surfaces in order to convey any accumulating fluids into the fluid-carrying channels.

Figure 1:
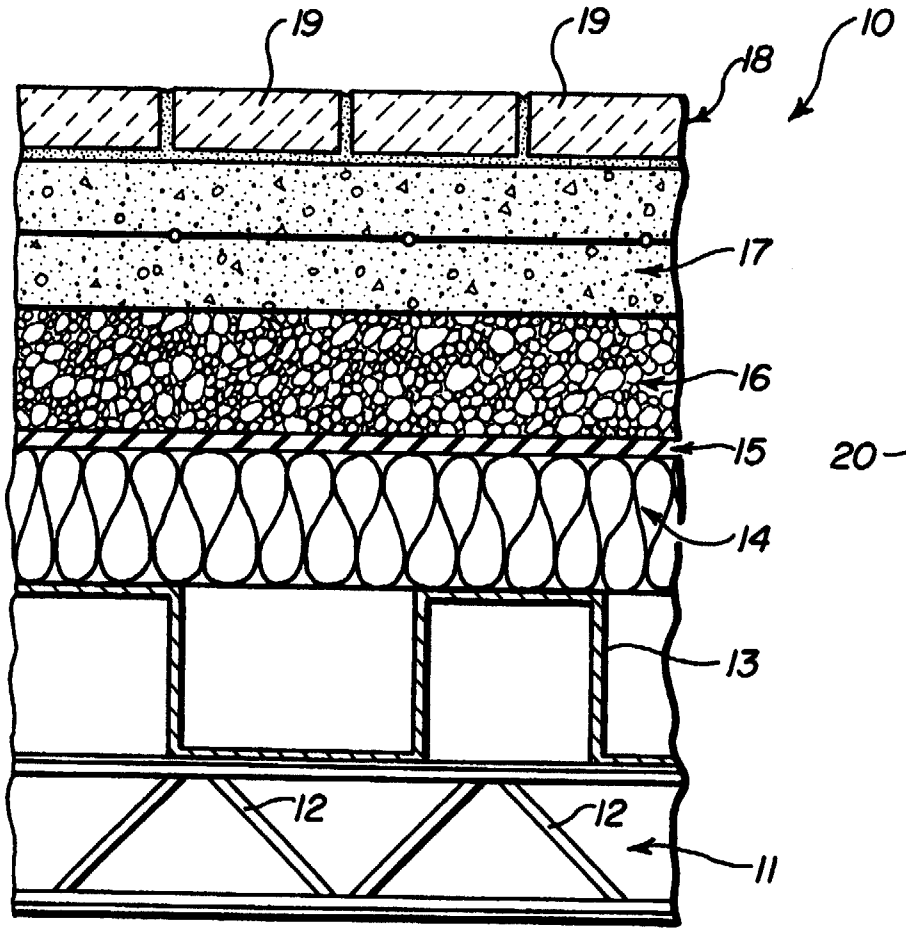
FIG-1 PRIOR ART
FIG. 1 depicts a cross-sectional view of a prior-art roof-deck construction, using a typical drainage mat configuration.

Now referring to FIG. 1, a cross-sectional view of a prior-art roof-and-deck construction 10 is shown. The roof comprises a first, supporting truss layer 11 consisting of support beams 12. On top of this truss layer 11 is disposed a conventional layer 13 of corrugated metal. On top of the corrugated metal layer 13, a layer 14 of insulation is provided. Immediately above the insulation layer 14, as is customary, a waterproof membrane 15 is provided, followed by a two-inch gravel layer 16 for drainage purposes. Above the gravel layer 16 is disposed a two-inch layer 17 of wire-reinforced concrete. The top surface 18 can comprise decorative ceramic tile or stone 19.

Figure 2:
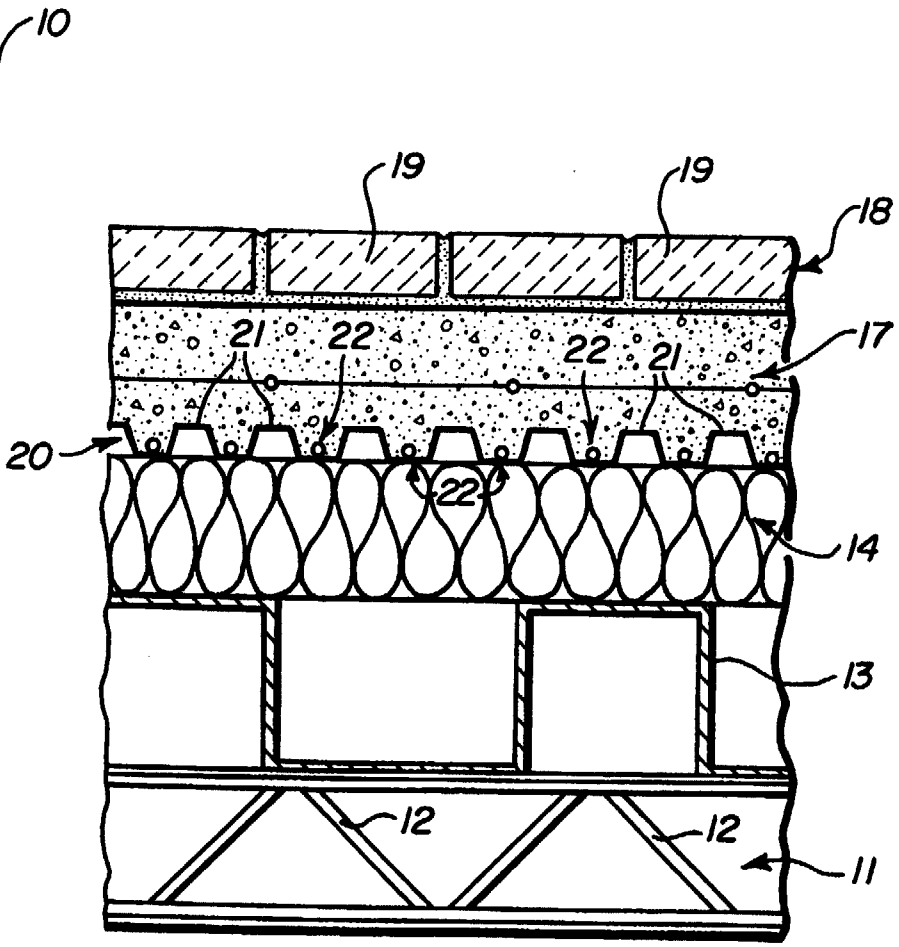
FIG. 2 illustrates a cross-sectional view of the drainage and support mat of this invention, as utilized in the roof-deck construction shown in FIG. 1.

Referring to FIG. 2, the invention features the first four layers comprising the truss layer 11, the corrugated metal layer 13, the insulation layer 14 and the top layer 18, as shown. The waterproof layer 15 and the gravel drainage layer 16 (FIG. 1) have now been replaced by the invention. The invention features a high-impact plastic mat 20. The mat 20 comprises a plurality of spaced-apart, truncated, trapezoidal protuberances 21. Drainage channels 22 are formed between the protuberances 21 for drawing off water seeping through the concrete layer 17. A better view of the mat 20 is illustrated in FIG. 3.

Figure 3:
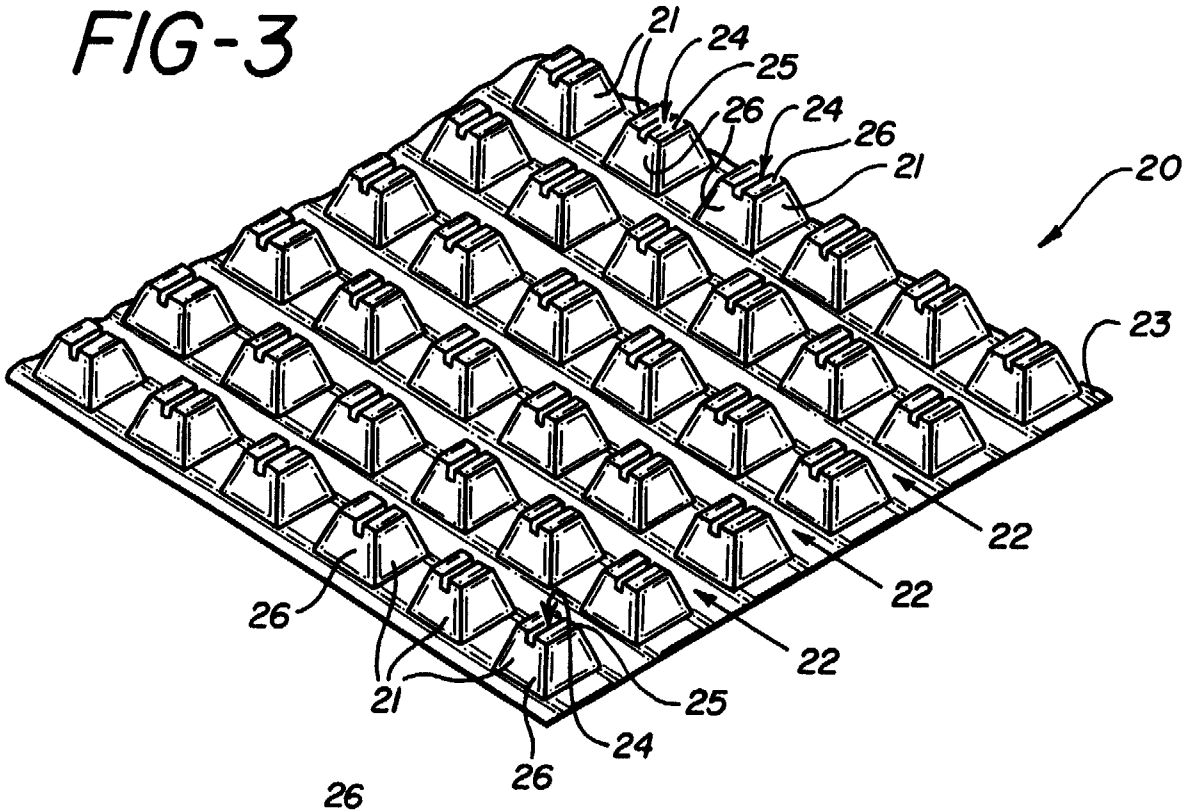
FIG. 3 shows a perspective view of the drainage and support mat of this invention.

Referring to FIG. 3, a high-impact plastic sheet 23 forming the mat 20 of this invention is illustrated. The mat 20 comprises rows of evenly spaced protuberances 21, as aforementioned. The protuberances comprise truncated, trapezoidal projections having drainage slots 24 disposed in a top, flattened surface 25. Water draining through the upper concrete layer 17 (FIG. 2) will be carried away by the channels 22 formed between the protuberances 21. Water which tends to accumulate on the upper, flattened surface 25 of each of the protuberances is carried away by the slots 24. The water on the upper surface 25 runs into the slot 24 and down the sides 26 of the protuberances 21 into channels 22.

The plastic sheet 23 can comprise plastics such as styrene, cycolac, PVC, PET and thermoplastic moldable plastics such as acrylics, ABS (acrylonitrile), butadiene styrene, nylon, PVC copolymer and butyl.

Figure 3B:
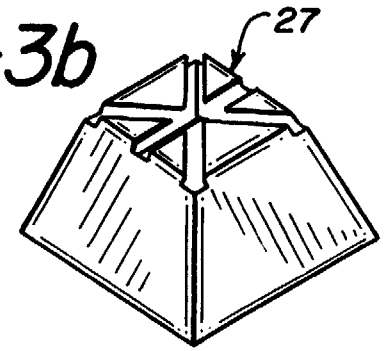
FIGS. 3*a* and 3*b* illustrate perspective views of alternate embodiments of the trapezoidal protuberances of the drainage and support mat shown in FIG. 3.
Figure 3A:
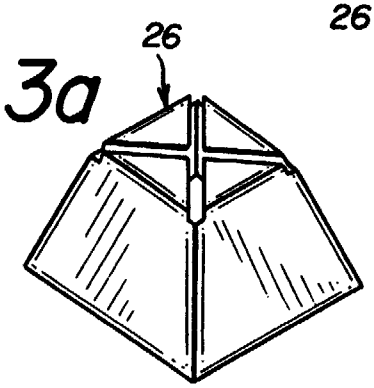

Slots 24 are usually single slot channels. However, slots 24 can be designed as squares 26 (as shown in FIG. 3*a*) or as stars 27 (illustrated in FIG. 3*b*). Varying shapes contemplated for the slot designs are for purposes of decoration only and provide no additional benefit.

Figure 4:
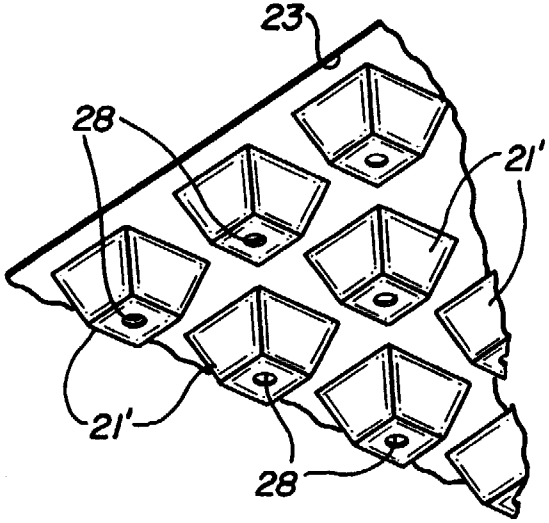
FIG. 4 depicts a partial, perspective view of an alternate embodiment of the drainage and support mat as shown in FIG. 3.

Referring to FIG. 4, an alternate embodiment of the invention is shown. Sheet 23 can be inverted. In such a case, the protuberances 21 of FIG. 3 now become wells 21'. In order for the water to run out of the wells 21', the slots 24 must now be cut through the plastic sheet. Slots 24 (FIG. 4) can also be designed as ordinary holes 28.

The truncated, trapezoidal shape of the protuberances 21 has been chosen to provide the extra strength required to support heavier loads (those generally exceeding 14,400 psf) .

Figure 5:
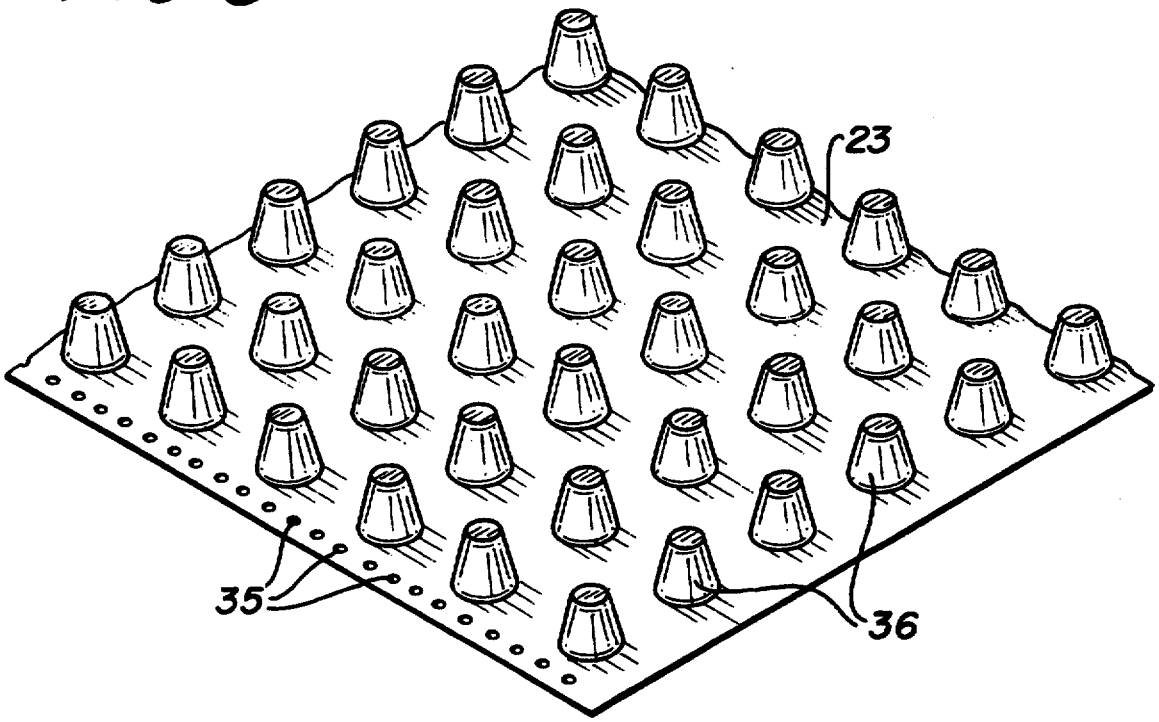
FIG. 5 illustrates a perspective view of yet another alternate embodiment of the drainage and support mat of this invention.
Figure 5A:
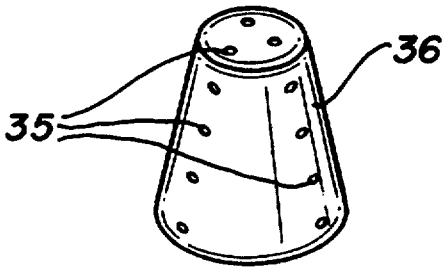
FIG. 5*a* presents a detailed, close-up view of a conical protuberance and perforations of the drainage and support mat shown in FIG. 5.

Referring to FIG. 5, a further alternate embodiment of the invention is shown. The plastic sheet 23 contains perforations 35 over at least 40% of the surface thereof. Protuberances are formed from the perforated sheet 23 and are shaped as cones 36, one of which is shown in greater detail in FIG. 5*a*.

Figure 6:
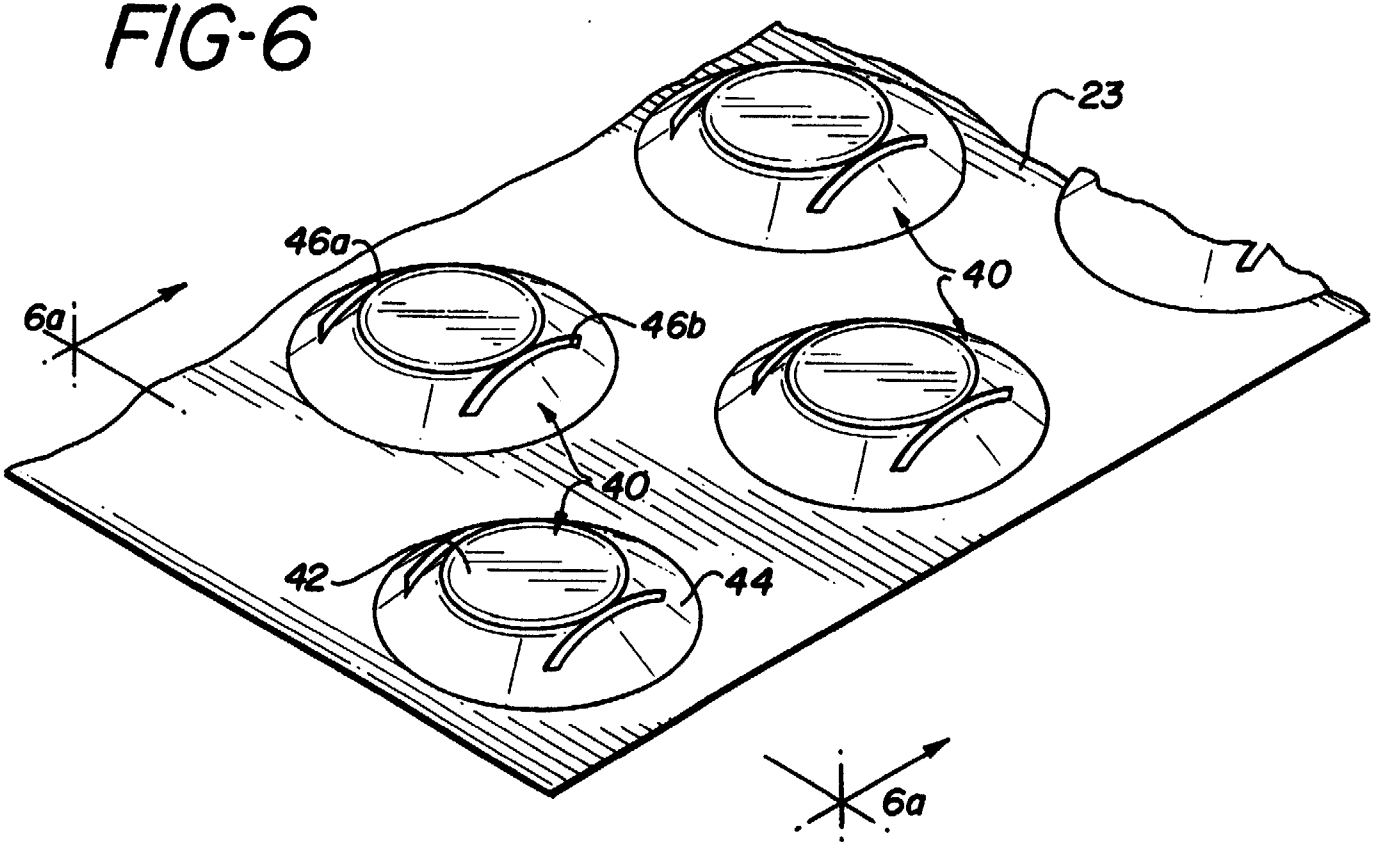
FIG. 6 illustrates a perspective view of yet another alternate embodiment of the drainage and support mat of this invention, in which hemispherical protrusions are used.
Figure 6A:
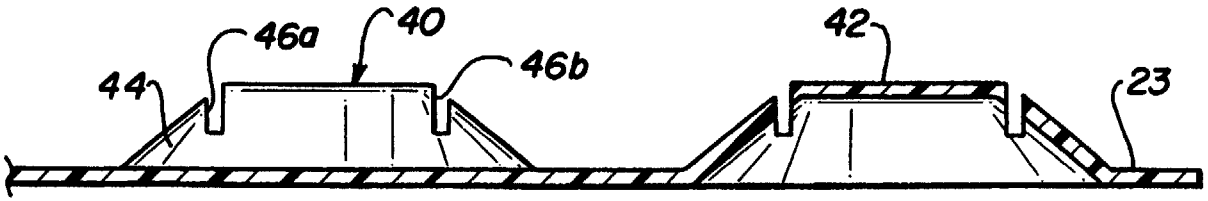
FIG. 6*a* presents a detailed, cross-sectional view of hemispherical protrusions of the drainage and support mat shown in FIG. 6, taken along lines 6*a*–6*a* thereof.

Referring to FIG. 6, a further alternate embodiment of the invention is shown. The plastic sheet 23 contains a plurality of hemispherical protrusions 40, which have also been found to possess excellent load-bearing properties. Protrusions 40 are formed from the sheet 23 and are cones having a flattened portion 42, raised up from sheet 23 and supported by cone walls 44, two of which protrusions 40 are shown in greater cross-sectional detail in FIG. 6*a*. Conical section-shaped slots 46*a* and 46*b* are disposed adjacent the flattened portion 42 of protrusions 40, to provide drainage as described hereinabove.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A drainage and support mat used in roof and deck construction, comprising a water-impermeable sheet having a number of spaced-apart, truncated protuberances, and means defining channels running between said truncated protuberances for providing for drainage of fluids from said mat, each of said truncated protuberances having a generally flat upper surface that tends to accumulate fluid, said fluid being conveyed from said generally flat upper surface of each truncated protuberance by means defining slots running across and traversing each of said upper surfaces of said truncated protuberances, said slots forming a star-shaped pattern that conveys water off said generally flat upper surface of said truncated protuberances to said channels running between said truncated protuberances.

2. The drainage and support mat in accordance with claim 1, wherein said truncated protuberances are shaped as truncated trapezoids.

3. The drainage and support mat in accordance with claim 1, wherein said truncated protuberances are shaped as truncated cones.

4. The drainage and support mat in accordance with claim 1, wherein said sheet comprises a material selected from a group of materials consisting of polystyrene, PVC, PET, cycolac, styrene, acrylics, ABS (acrylonitrile), butadiene styrene, nylon and butyl.

5. A drainage and support mat used in roof and deck construction, comprising a water-impermeable sheet having a number of spaced-apart protrusions, said protrusions being shaped in a substantially truncated, hemispherical fashion to provide high-impact resistance, and means defining channels running between said protrusions for providing for drainage of fluids from said mat, each of said protrusions having a generally flat upper surface and means, adjacent thereto, defining at least one slot for conveying said fluid from said generally flat upper surface of each protrusion to said channels running between said protrusions.

6. The drainage and support mat in accordance with claim 5, wherein said sheet comprises a material selected from a group of materials consisting of polystyrene, PVC, PET, cycolac, styrene, acrylics, ABS (acrylonitrile), butadiene styrene, nylon and butyl.

7. The drainage and support mat in accordance with claim 5, wherein said mat is inverted when used in a roof or deck construction, and wherein said protrusions form wells that accumulate fluid, said slots being cut through said sheet to allow for drainage of said wells.

8. A drainage and support mat used in roof and deck construction, comprising a water-impermeable, high-impact plastic sheet having a number of spaced-apart protuberances, said protuberances being shaped as substantially truncated trapezoids to provide high-impact resistance and the support for heavy loads, and means defining channels running between said protuberances for providing for drainage of fluids from said mat, each of said protuberances having a generally flat upper surface that tends to accumulate fluid, said fluid being conveyed from said generally flat upper surface of each protuberance to said channels running between said protuberances by means defining an "X"-shaped slot running across each of said upper surfaces of said protuberances.

9. The drainage and support mat in accordance with claim 8, wherein said sheet comprises a material selected from a group of materials consisting of polystyrene, PVC, PET, cycolac, styrene, acrylics, ABS (acrylonitrile), butadiene styrene, nylon and butyl.

10. A drainage and support mat used in roof and deck construction, comprising a water-impermeable sheet having a number of spaced-apart, truncated protuberances, and means defining channels running between said truncated protuberances for providing for drainage of fluids from said mat, each of said truncated protuberances having a generally flat upper surface that tends to accumulate fluid, said fluid being conveyed from said generally flat upper surface of each truncated protuberance by means defining slots running across and traversing each of said upper surfaces of said truncated protuberances, said slots forming an X-shaped pattern that conveys water from said truncated protuberances to said channels running between said truncated protuberances.

* * * * *